US006910654B2

(12) United States Patent
Kawano et al.

(10) Patent No.: US 6,910,654 B2
(45) Date of Patent: Jun. 28, 2005

(54) APPARATUS AND METHOD FOR WINDING MULTI-LAYER COIL IN TRAPEZOIDAL WINDING SPACE

(75) Inventors: Keisuke Kawano, Kariya (JP); Noriyasu Inomata, Toyota (JP); Motoya Ito, Hekinan (JP); Hiroyuki Yamamoto, Nukata-gun (JP)

(73) Assignee: Denso Corporation (JP)

( * ) Notice: Subject to any disclaimer, the term of this patent is extended or adjusted under 35 U.S.C. 154(b) by 140 days.

(21) Appl. No.: 10/412,287

(22) Filed: Apr. 14, 2003

(65) Prior Publication Data

US 2003/0209627 A1 Nov. 13, 2003

(30) Foreign Application Priority Data

May 10, 2002 (JP) ..... 2002-135460

(51) Int. Cl.[7] ..... B65H 54/28

(52) U.S. Cl. ..... 242/447.1; 242/444.2; 242/437.3; 242/478.1; 242/157.1

(58) Field of Search ..... 242/443, 444.2, 242/437, 437.3, 447.1, 447.2, 478.1, 411, 157.1

(56) References Cited

U.S. PATENT DOCUMENTS 4,150,801 A * 4/1979 Ikegami et al. ..... 242/478.1
5,564,637 A * 10/1996 Berthold et al. ..... 242/477
5,692,483 A 12/1997 Wada et al.
6,375,113 B1 * 4/2002 Ishimaru et al. ..... 242/447.1
6,499,689 B1 * 12/2002 Miyazaki ..... 242/478.1
2001/0015393 A1 * 8/2001 Miyazaki et al. ..... 242/437.3

FOREIGN PATENT DOCUMENTS

JP 8-34167 3/1996
JP 8-225244 9/1996

OTHER PUBLICATIONS

Reasons for Rejection of Japanese Application No. 2002–135460; dated Dec. 15, 2004 (2 pages); English translation (1 page).

* cited by examiner

*Primary Examiner*—Kathy Matecki
*Assistant Examiner*—Evan Langdon
(74) *Attorney, Agent, or Firm*—Nixon & Vanderhye PC

(57) ABSTRACT

A multi-layer coil is wound around a bobbin having a center pillar and a small and a large flanges connected to longitudinal ends of the center pillar. A winding space having a trapezoidal cross-section in a plane cut through the center axis of the bobbin is formed outside the center pillar between both flanges. To wind the multi-layer coil in this winding space, a turning position where a layer of the coil moves up to a higher layer is set by a position setter, and the turning position is automatically shifted layer by layer to form a sloped outer surface of the coil. The coil is wound in a shape fitting the trapezoidal winding space without reducing the winding speed. The space factor of the coil in the winding space is improved, making the coil compact in size.

14 Claims, 9 Drawing Sheets

APPARATUS AND METHOD FOR WINDING MULTI-LAYER COIL IN TRAPEZOIDAL WINDING SPACE

CROSS-REFERENCE TO RELATED APPLICATION

This application is based upon and claims benefit of priority of Japanese Patent Application No. 2002-135460 filed on May 10, 2002, the content of which is incorporated herein by reference.

BACKGROUND OF THE INVENTION

1. Field of the Invention

The present invention relates to an apparatus for winding a multi-layer coil in a trapezoidal winding space, and a method of winding such a coil.

2. Description of Related Art

A conventional apparatus for winding a multi-layer coil in a winding space having a trapezoidal cross-section is shown in FIGS. 11A–11D. A bobbin 100 is composed of a center pillar 102, a small flange 104 connected to one end of the center pillar 102, and a large flange 106 connected to the other end of the center pillar 102. A wire 200 is wound in a winding space formed outside of the center pillar 102 between the small flange 104 and the large flange 106. The winding space has a trapezoidal cross-section in a plane cut through a center axis of the center pillar 102.

The wire 200 is wound in the winding space in a winding process shown in FIG. 11A through FIG. 1D. The bobbin 100 is fixed to a rotating shaft such as a rotating spindle (not shown), and a wire 200 is fed from a feeder nozzle 36. The feeder nozzle 36 is connected to a holder 34 that is supported on a shaft 32 and is movable back and forth in a direction along the center axis of the bobbin 100. As shown in FIG. 11A, the wire 200 is wound in a space between the large flange 106 and the small flange 104 until layers of the wire reach a height of the small flange 104. Thereafter, as shown in FIGS. 11B–11D, the number of wire-turns in one layer is gradually decreased until a top layer reaches the height of the large flange 106. In this particular example shown here, two turns, i.e., two-wire-pitches, are decreased layer by layer. According to the movement of the feeder nozzle 36 in the axial direction, the winding direction of each layer is switched at a turning position at the right side. In this manner, a coil 110 is wound in the trapezoidal winding space.

Since the wire 200 is simply guided by the feeder nozzle 36 in the conventional winding process, the turning position of each layer may be deviated from an intended turning position. This means that the coil 110 may be wound in an irregular shape, resulting in decrease in a space factor of the coil 110 in the winding space. The space factor is defined as a ratio of a total cross-sectional area of the wire 200 relative to a cross-sectional area of the winding space. In addition, the wire 200 crosses over the wire of a lower layer at the turning position, and an outer diameter of the coil 110 is enlarged at the cross-over points. Therefore, if the turning positions deviate in the circular direction, the diameter of the coil 110 becomes large. This also results in a decrease in the space factor.

It would be possible to suppress the deviation of the turning positions by decreasing a winding speed or by temporarily stopping the winding process at each turning position. However, this reduces the winding speed and sacrifices production efficiency.

SUMMARY OF THE INVENTION

The present invention has been made in view of the above-mentioned problems, and an object of the present invention is to provide an improved apparatus for winding a multi-layer coil in a trapezoidal winding space, which is able to keep the turning position at a required position and to improve the space factor without reducing the winding speed. Another object of the present invention is to provide an improved method of winding such a multi-layer coil.

The multi-layer coil is wound around a bobbin composed of a center pillar, a small flange connected one longitudinal end of the center pillar and a large flange connected to the other end. A winding space around the bobbin is defined outside the center pillar and between both flanges. The winding space has a trapezoidal cross-section in a plane cut through the center axis of the center pillar.

In a winding process, the center pillar is coupled to a rotating shaft to thereby rotate the bobbin. A wire to be wound is supplied from a wire feeder that moves in a direction parallel to the center axis. Inner layers of the coil are wound in an inner space having a rectangular cross-section between the small flange and the large flange until the height of the inner layers reaches the height of the small flange. Then, outer layers of the coil are wound around the inner layers in an outer space having a triangular cross-section. The number or turns in one layer is gradually reduced layer by layer by shifting a turning position where one layer moves up to a higher layer at the small flange side. The turning position is shifted toward the large flange by predetermined wire-pitches, e.g., two-wire-pitches.

The turning position of each outer layer is set by a position setter that is movable to positions corresponding to respective layers. The position setter may include plural setting steps each corresponding to each layer. In this case, the position setter is fixed at one place, and turning positions of all the layers are set by respective setting steps. Alternatively, plural setting members each movable to the turning position of each layer may be used. Since the wire crosses over the wire of a lower layer at the turning position and diameter of the coil swells at the crossover point, it is preferable to place all the turning positions at a predetermined peripheral position or positions of the bobbin. By placing the turning positions at a predetermined periphery of the bobbin, the coils can be disposed in a close contact to each other in a small mounting space.

The coils wound in the winding space having a trapezoidal cross-section can be used in various rotary electric machines. For example, plural coils can be circularly arranged in an armature of a fuel pump for pumping up fuel in a fuel tank. Because a sloped surface of a coil can closely contact with that of another coil, a space for mounting the coils in the armature is minimized.

According to the present invention, since the turning positions are exactly set at predetermined positions, all the layers forming the coil are encompassed within the winding space having the trapezoidal cross-section. The space factor of the coil in the winding space is improved, and therefore the coil can be made compact in size. Further, the coil is wound at a high speed because the turning positions are set by means of the position setter without reducing the winding speed.

Other objects and features of the present invention will become more readily apparent from a better understanding of the preferred embodiments described below with reference to the following drawings.

DETAILED DESCRIPTION OF THE PREFERRED EMBODIMENTS

Figure 1A:
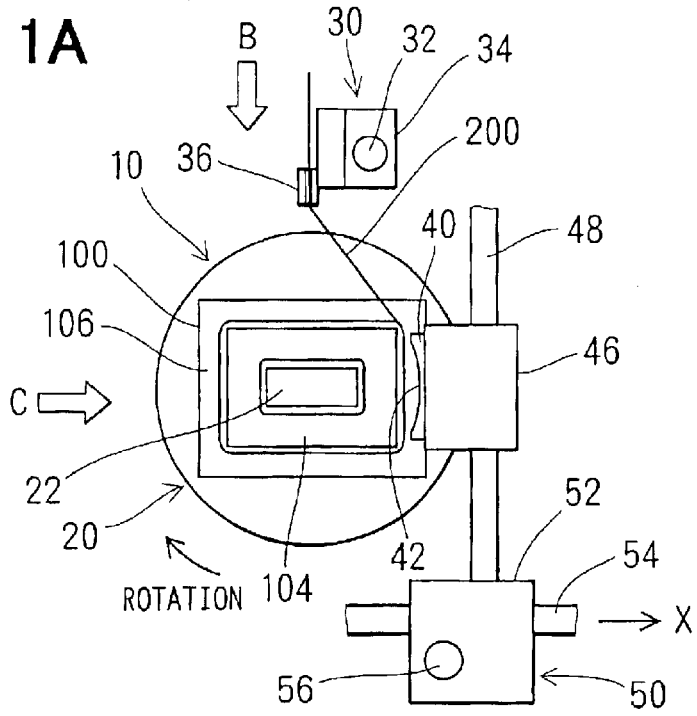
FIG. 1A is a front view showing an apparatus for winding a multi-layer coil in a trapezoidal winding space.
Figure 1B:
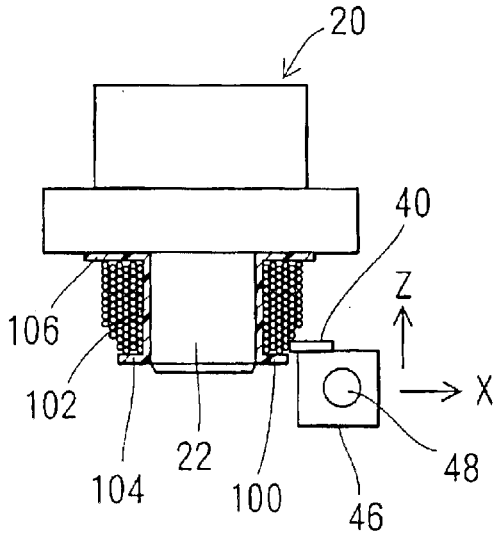
FIG. 1B is a top view showing a part of the winding apparatus shown in FIG. 1A, viewed in direction B in FIG. 1A.
Figure 1C:
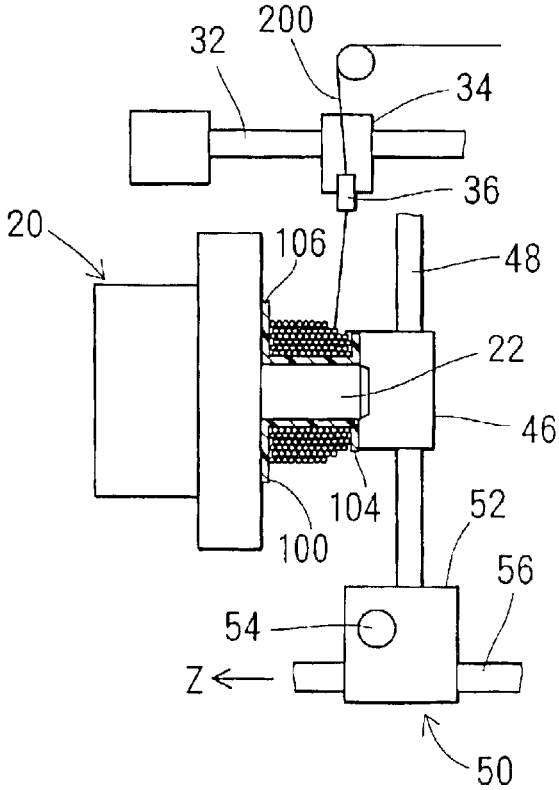
FIG. 1C is a side view showing the winding apparatus shown in FIG. 1A, viewed in direction C in FIG. 1A.

A first embodiment of the present invention will be described with reference to FIGS. 1A–4. First, referring to FIGS. 1A–1C, an apparatus for winding a multi-layer coil in a trapezoidal winding space will be described. A winding apparatus 10 includes a spindle 20 for rotating a bobbin 100, a wire feeder 30, a position setter 40 and a moving device 50. A bobbin 100 is composed of a center pillar 102, a small flange 104 connected to one end of the center pillar 102 and a large flange 106 connected to the other end of the center pillar 102. A winding space of the bobbin 100 is formed outside of the center pillar 102 between the small flange 104 and the large flange 106, and has a trapezoidal cross-section in a plane cut through a center axis of the center pillar 102.

The center pillar 102 is a hollow pillar having a rectangular cross-section. Both of the small flange 104 and the large flange 106 are rectangular plates connected to the center pillar 102. The center pillar 102 is coupled to rotating spindle shaft 22. The wire feeder 30 includes a shaft 32, holder 34 supported by the shaft 32 and a feeder nozzle 36 connected to the holder 34. The holder 34 slidably moves on the shaft 32 in a direction parallel to the center axis of the bobbin 100. The holder 34 is reciprocated back and forth on the shaft 32 by a mechanism such as a driving screw. A wire 200 to be wound in the winding space of the bobbin 100 is fed from the feeder nozzle 36. One end of the wire 200 is connected to the spindle 20, and the wire 200 fed from the feeder nozzle 36 is wound around the center pillar 102 of the bobbin 100.

The position setter 40 is held by a holder 46 that is connected to a shaft 48. The holder 46 connected to the shaft 48 is driven in both directions X and Z (shown in FIG. 1B) by a supporter 52. The supporter 52 is slidably coupled to a shaft 54 extending in direction X and another shaft 56 extending in direction Z. In this manner, the position setter 40 having a guide surface 42 for guiding the wire 200 is movable in both the axial direction (direction Z) and the direction (direction X) perpendicular to the axial direction.

Figures 2A, 2B, 2C, 2D:
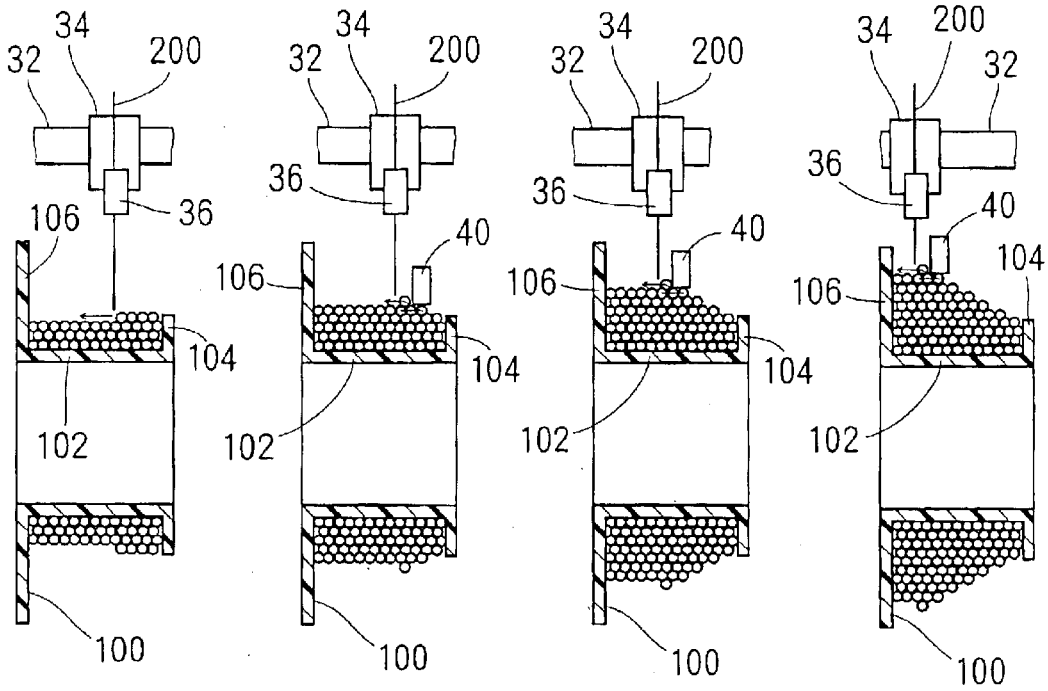
FIGS. 2A–2D sequentially illustrate a winding process in a first embodiment of the present invention.

Referring to FIGS. 2A–2D, operation of the winding apparatus 10 will be described. As shown in FIG. 2A, inner layers of the coil 110 are wound in a space between the small flange 104 and the large flange 106 until the inner layers reach a height of the small flange 104. The wire 200 is guided back and forth in direction Z by the feeder nozzle 36. As shown in FIGS. 2B–2C, outer layers of the coil 110 are wound in a space having a triangular cross-section. As shown in FIG. 2B, a first layer of the outer layers is wound from the large flange 106 toward the small flange 104, and turned at a first turning position that is set by the position setter 40. Then, a second layer of the outer layer is wound toward the large flange 106 starting at a second turning position set by the position setter 40. As shown in FIGS. 2C and 2D, this process is repeated until the outer layers of the coil 110 completely fills the upper layer space. In this manner, the wire 200 is wound to fill the entire trapezoidal winding space, thereby forming the coil 110.

Figure 3A:
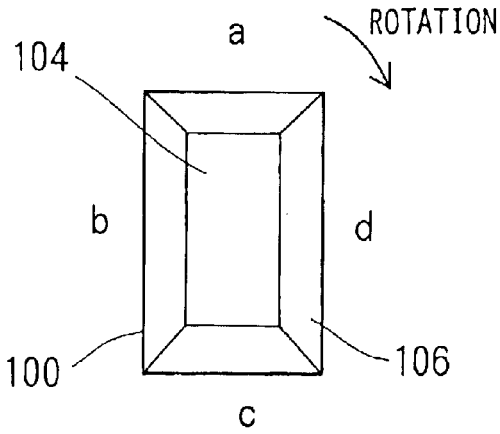
FIGS. 3A and 3B are drawings for explaining turning positions of a wire wound in the process shown in FIGS. 2A–2D.
Figure 3B:
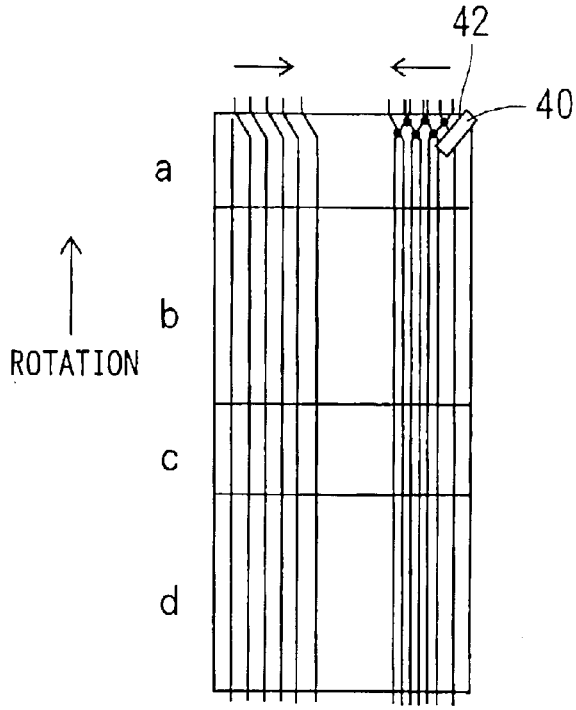

As shown in FIG. 3A, the rectangular bobbin 100 has a pair of short sides "a" and "c", and a pair of long sides "b" and "d". The position setter 40 having the guide surface 42 slanted as shown in FIG. 3B smoothly guides the wire 200 during the winding process. The position setter 40 sets the respective turning positions of each outer layer, so that the number of turns in each outer layer is gradually reduced by a predetermined number of turns. In this particular embodiment, two turns are reduced layer by layer. In other words, the right side end of each outer layer is shifted toward the large flange 106 by two-wire-pitches. FIG. 3B shows an exploded view of the four sides a–d of the bobbin 100. As shown in FIG. 3B, the turning positions of all outer layers are set on the short side "a". At each turning position, the wire 200 crosses over the wire 200 of a lower layer.

Figure 4:
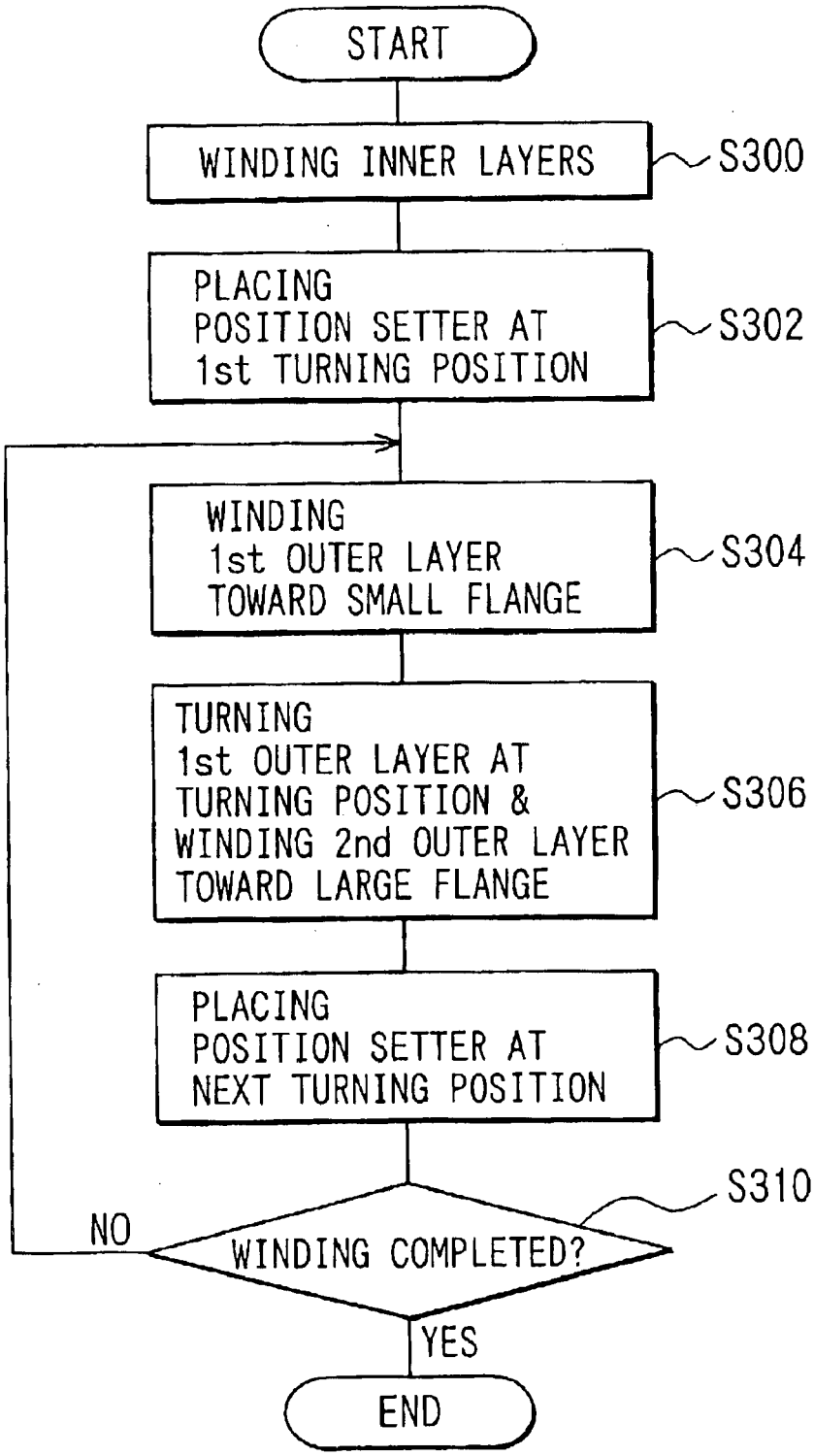
FIG. 4 is a flowchart showing the winding process illustrated in FIGS. 2A–2D.
Figure 5A:
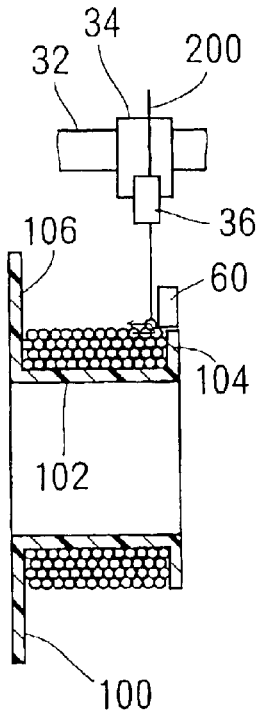
FIGS. 5A–5D sequentially illustrate a winding process in a modified form of the first embodiment.
Figure 5B:
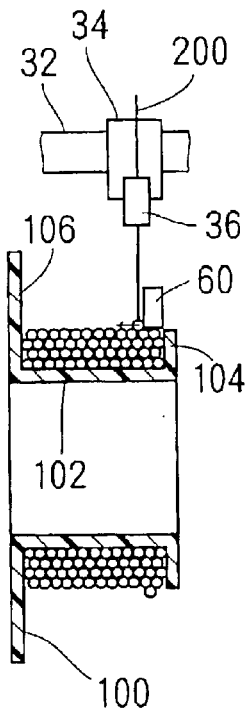
Figure 5C:
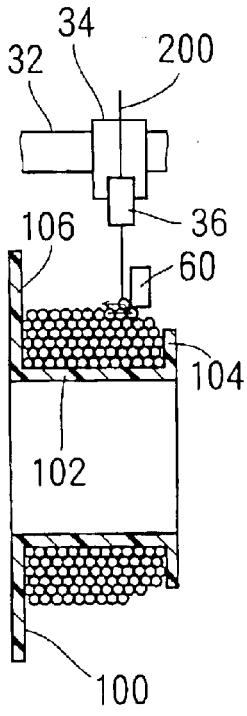
Figure 5D:
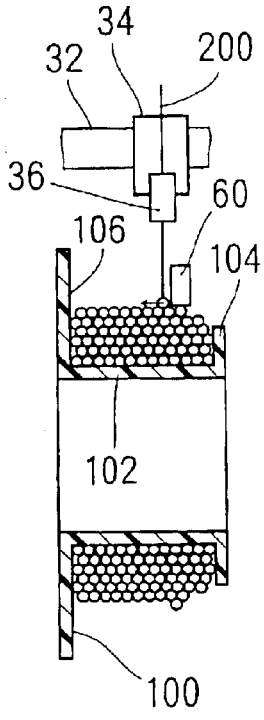

Now, the winding process described above will be further explained with reference to a flowchart shown in FIG. 4. At step S300, the inner layers of the coil 110 are wound up to the height of the small flange 104 by reciprocating the feeder nozzle 36 in the axial direction of the bobbin 100. At step S302, the position setter 40 is placed at the first turning position before the first outer layer wound from the large flange side toward the small flange side reaches the first turning position. At step S304, the first outer layer is wound, starting from the large flange 106, toward the small flange 104. The first outer layer is stopped at the first turning position set by the position setter 40, and the second outer layer is wound from the small flange side toward the large flange side while the starting position of the second outer layer is shifted toward the large flange side by two-wire-pitches. At step S308, the next turning position is set by the position setter 40. At step S310, the steps S304–S308 are repeated until the all layers are wound, forming the coil 110. If it is determined that an entire winding process is completed, the process comes to the end.

Figure 6A:
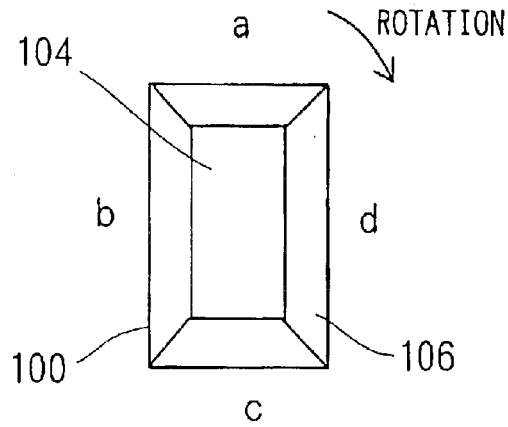
FIGS. 6A and 6B are drawings for explaining turning positions of a wire wound in the process illustrated in FIGS. 5A–5D.
Figure 6B:
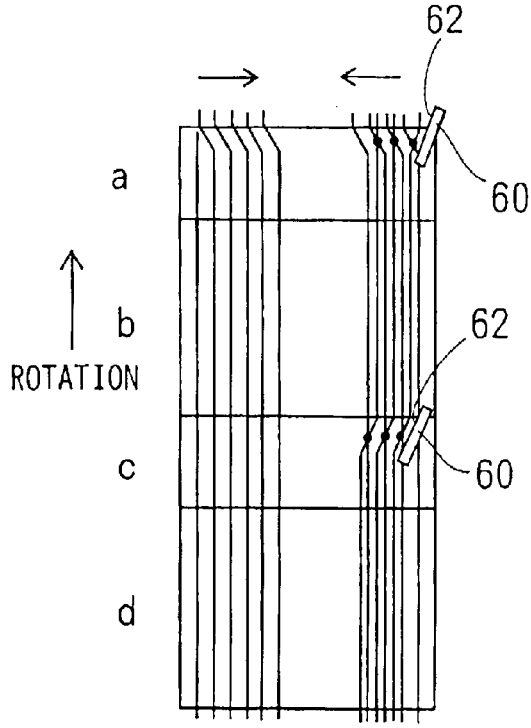

Referring to FIGS. 5A–5D and FIGS. 6A–6B, a modified form of the first embodiment will be described. In the first embodiment, all the turning positions are set on the short side "a" of the bobbin 100, and two-wire-pitches are shifted at each turning position. In this modified form, however, only one-wire-pitch is shifted at the turning position set on the short side "a", and another one-wire-pitch is shifted on the next short side "c", as shown in FIG. 6B. A position setter 60 guides the wire 200 to shift the wire on both short sides "a" and "b" by one-wire-pitch each, as illustrated in FIGS. 5A–5D. The number of turns in each outer layer is reduced by two turns layer by layer in the same manner as in the first embodiment.

Figure 7:
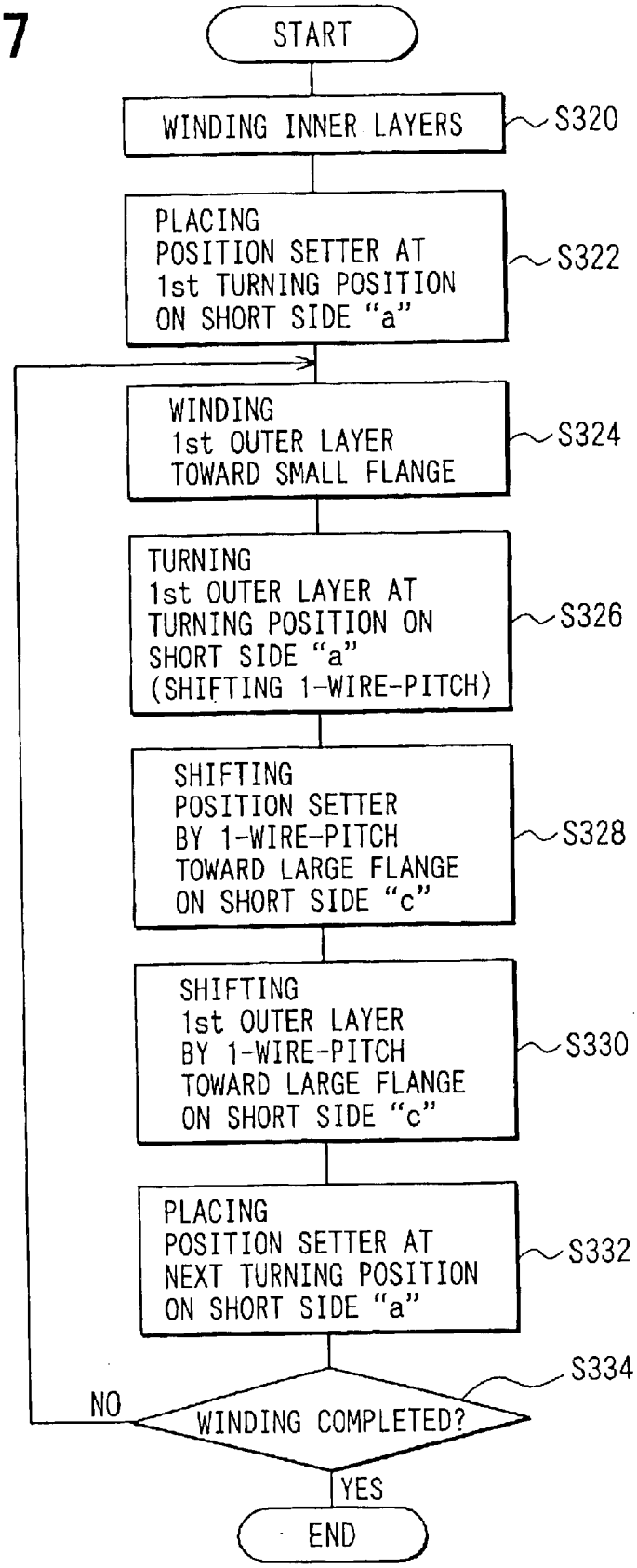
FIG. 7 is a flowchart showing the winding process illustrated in FIGS. 5A–5D.

Referring to the flowchart shown in FIG. 7, the modified form of the winding process shown in FIGS. 5A–5D will be further explained. At step S320, the inner layers of the coil 110 are wound until the inner layers reach the height of the small flange 104. At step S322, the position setter 60 is placed at the first turning position before the first outer layer is wound. The first turning position is set on the short side "a" with one-slot-pitch shifted toward the large flange 106. At step S324, the first outer layer is wound from the large flange side toward the small flange side and is stopped at the first turning position. At step S326, the wire is turned at the first turning position to wind the second outer layer from the short flange side toward the large flange side.

Then, at step S328, the position setter 60 is shifted one-wire-pitch toward the large flange side on the short side "c". At step S330, the wire is shifted one-wire-pitch toward the large flange 106 on the short side "c", guided by the position setter 60. At step S332, the position setter 60 is placed at the next turning position on the short side "a". Then, at step S334, the steps S324–S332 are repeated until all the outer layers are wound to fill the outer layer space having a triangular cross-section. When the entire winding process completed, the process comes to the end.

A second embodiment of the present invention will be described with reference to FIGS. 9A–9D. In this embodiment, the position setter 40 used in the first embodiment is replaced with a position setter 90, and other structures are the same as those of the first embodiment. The position setter 90 has plural setting steps 92, each of which corresponds to the turning position of each outer layer. In this embodiment, the position setter 90 is not moved during the winding process. The turning positions of each outer layer are set by the respective setting steps 92 without changing the position of the position setter 90.

A third embodiment of the present invention will be described with reference to FIGS. 10A–10D. In this embodiment, plural setting members 96 each corresponding to each outer layer are employed. Each position setter 96 is individually controlled, so that each position setter 96 is placed at a turning position required for each outer layer.

Advantages attained in the foregoing embodiments and their modified forms will be summarized below. Since the turning positions of the outer layers to be wound in the outer space having a triangular cross-section are set by the position setter, the turning positions are exactly determined without deviation. Accordingly, the coil 110 can be correctly shaped to be encompassed within the winding space having a trapezoidal cross-section. Therefore, the space factor of the coil 110 in the winding space is greatly improved, and the coil 110 can be made small in size. This can be achieved without slowing down the winding speed. Therefore, the production efficiency is improved. In addition, the crossover points of the wire 200 are set on a predetermined bobbin side "a", or predetermined bobbin sides "a" and "c". This also contributes to reducing the coil size.

Figure 8A:
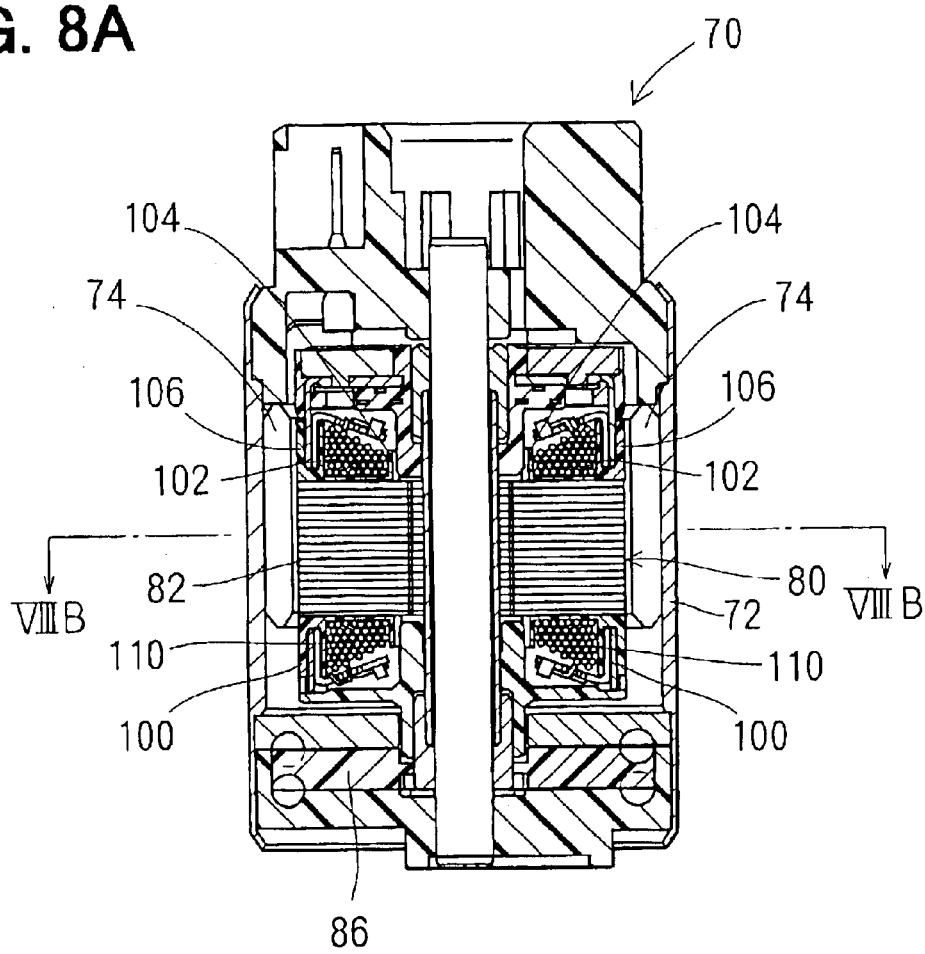
FIG. 8A is a cross-sectional view showing a fuel pump in which the coils wound according to the present invention are used.
Figure 8B:
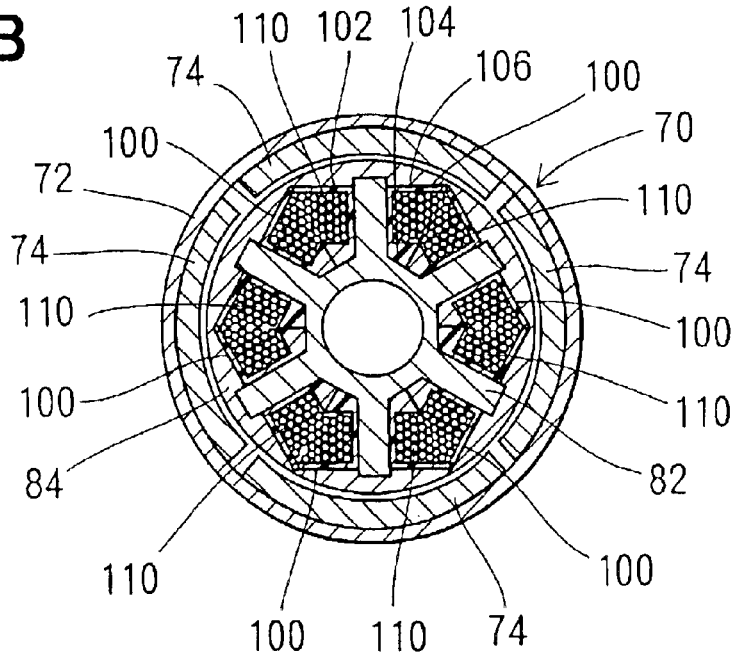
FIG. 8B is a cross-sectional view showing the fuel pump shown in FIG. 8A, taken along line VIIIB—VIIIB in FIG. 8A.
Figure 9A:
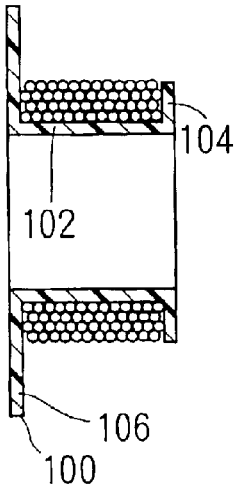
FIGS. 9A–9D sequentially illustrate a winding process in a second embodiment of the present invention.
Figure 9B:
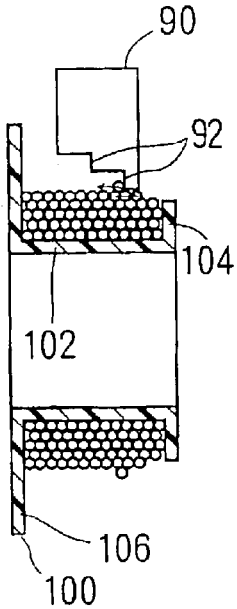
Figure 9C:
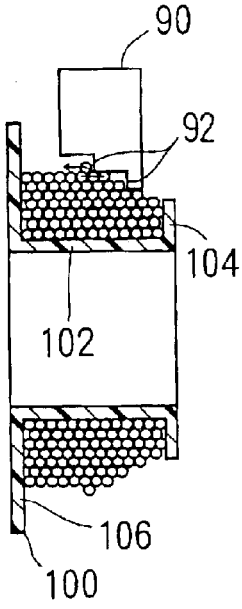
Figure 9D:
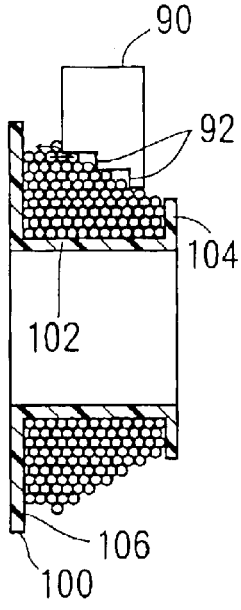
Figure 10A:
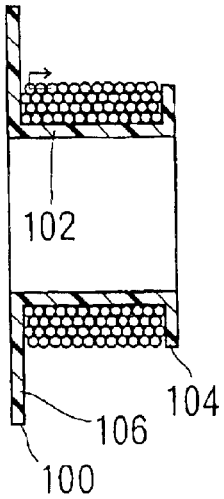
FIGS. 10A–10D sequentially illustrate a winding process in a third embodiment of the present invention.
Figure 10B:
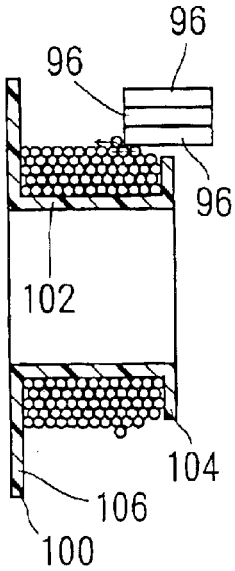
Figure 10C:
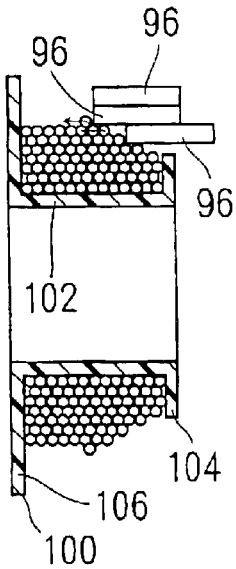
Figure 10D:
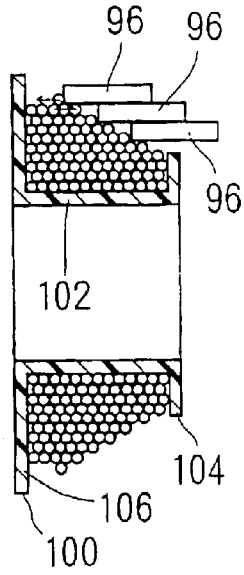
Figure 11A:
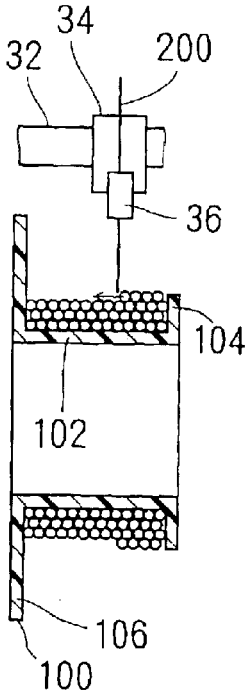
FIG. 11A PRIOR ART
FIGS. 11A–11D are drawings showing a conventional process for winding a multi-layer coil in a trapezoidal winding space.
Figure 11B:
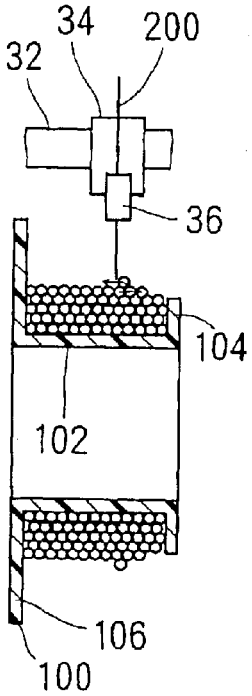
FIG. 11B PRIOR ART
Figure 11C:
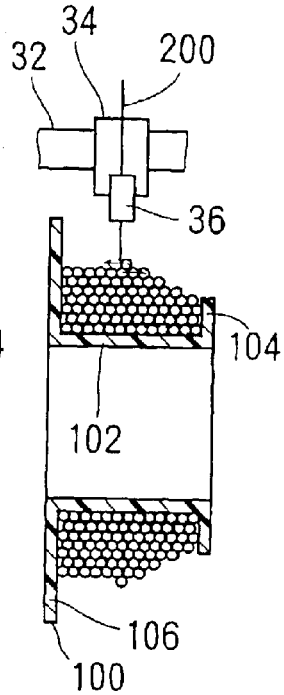
FIG. 11C PRIOR ART
Figure 11D:
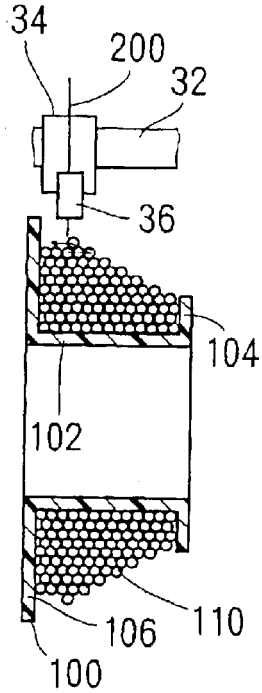
FIG. 11D PRIOR ART

The coil 110 wound in the winding space having a trapezoidal cross-section can be used in various electric machines. A fuel pump in which the coils 110 are used is shown in FIGS. 8A and 8B as an example. The fuel pump 70 is submerged in a fuel tank of an automotive vehicle to pump up fuel and to supply the pumped up fuel to an automotive engine. The fuel pump 70 is mainly composed of a cylindrical housing 72, four permanent magnets 74 connected to an inner bore of the cylindrical housing 72, an armature 80 rotatably supported inside the permanent magnets 74, and an impeller 86 rotated by the armature 80. The armature 80 includes an inner core 82, an outer core 84 and six coils 110 disposed between the inner core 82 and the outer core 84.

The inner core 82 has six legs extending in the radial direction, and each leg is inserted into the bobbin 100 of the coil 110 so that the large flange 106 is positioned outside and the short flange 104 inside. The coils 110 are circularly arranged so that the sloped outer surfaces of the neighboring coils 110 closely contact each other, as shown in FIG. 8B. In this manner, a space required for disposing six coils inside the outer core 84 is minimized. The crossover points of the wire 200 are positioned on the short side "a" or on short sides "a" and "c" as described above, and no crossover point is positioned on the long sides "b" and "d". Since the coils 110 are disposed so that the sloped surfaces formed on the long sides contact each other, the sloped surfaces contacting each other do not include the crossover points that irregularly increase the outer diameter of the coil 110. Therefore, six coils 110 can be disposed inside the outer core 84 in a space-saving manner.

While the present invention has been shown and described with reference to the foregoing preferred embodiments, it will be apparent to those skilled in the art that changes in form and detail may be made therein without departing from the scope of the invention as defined in the appended claims.

What is claimed is:

1. An apparatus for winding a multi-layer coil in a winding space of a bobbin having a center pillar, a small flange connected to one end of the center pillar and a large flange connected to the other end of the center pillar, the winding space being defined outside the center pillar between both flanges and having a trapezoidal cross-section in a plane cut through a center axis of the center pillar, the winding apparatus comprising:

a rotating device for rotating the bobbin around the center axis thereof;

a wire feeder for supplying a wire forming the multi-layer coil, the wire feeder being reciprocally moved in a direction parallel to the center axis for winding each layer of the coil; and a position setter for setting a turning position where a layer of the coil wound from the large flange toward the small flange is switched to a next layer wound from the small flange toward the large flange, the position setter being disposed and held radially outside an outer peripheral edge of the small flange so that the position setter is free to move axially with respect to the small flange wherein:

inner layers of the coil are wound around the center pillar in a space between the small flange and the large flange until a height of the inner layers reaches a height of the small flange, and thereafter outer layers are wound on the inner layers while shifting the turning position set by the position setter toward the large flange by predetermined wire-pitches for each layer, thereby forming the multi-layer coil encompassed within the winding space having the trapezoidal cross-section.

2. The winding apparatus as in claim 1, wherein:

all of the turning positions are located at predetermined peripheral positions of the bobbin.

3. The winding apparatus as in claim 2, wherein:

all of the turning positions are fixed to one peripheral position of the bobbin.

4. The winding apparatus as in claim 1, wherein:

the position setter is a single unit movable to the turning position of each layer.

5. The winding apparatus as in claim 1, wherein:

the position setter includes a plurality of setting members, each setting member corresponding to each layer and movable to the turning position of each layer.

6. An apparatus for winding a multi-layer coil in a winding space of a bobbin having a center pillar, a small flange connected to one end of the center pillar and a large flange connected to the other end of the center pillar, the winding space being defined outside the center pillar between both flanges and having a trapezoidal cross-section in a plane cut through a center axis of the center pillar, the winding apparatus comprising:

a rotating device for rotating the bobbin around the center axis thereof;

a wire feeder for supplying a wire forming the multi-layer coil, the wire feeder being reciprocally moved in a direction parallel to the center axis for winding each layer of the coil; and a position setter for setting a turning position where a layer of the coil wound from the large flange toward the small flange is switched to a next layer wound from the small flange toward the large flange, wherein:

inner layers of the coil are wound around the center pillar in a space between the small flange and the large flange until a height of the inner layers reaches a height of the small flange, and thereafter outer lavers are wound on the inner lavers while shifting the turning position toward the large flange by predetermined wire-pitches for each layer, thereby forming the multi-layer coil encompassed within the winding space having the trapezoidal cross-section, wherein:

the position setter is a single unit that includes a plurality of setting steps, the position setter being fixedly positioned so that each setting step corresponds to the turning position of each layer.

7. The winding apparatus as in claim 1, wherein:

the position setter includes a guide surface for smoothly guiding the wire supplied from the wire feeder toward the large flange at the turning position.

8. The winding apparatus as in claim 2, wherein:

the center pillar of the bobbin is a hollow pillar having a rectangular cross-section.

9. A method of winding a multi-layer coil in a winding space of a bobbin having a center pillar, a small flange connected to one end of the center pillar and a large flange connected to the other end of the center pillar, the winding space being defined outside the center pillar between both flanges and having a trapezoidal cross-section in a plane cut through a center axis of the center pillar, the winding method comprising:

winding a wire around the center pillar of the bobbin in an inner space between the small flange and the large flange, forming inner layers of the wire, until a height of the inner layers reaches a height of the small flange; and further winding the wire around the inner layers, forming outer layers of the wire, while gradually decreasing, layer by layer, number of wire-turns included in each layer by setting a turning position where each layer moves up to a next layer and by shifting the turning position toward the large flange, thereby forming the multi-layer coil encompassed within the winding space having the trapezoidal cross-section, the turning position being set by a position setter disposed and held radially outside an outer peripheral edge of the small flange so as not to engage the small flange.

10. The winding method as in claim 9, wherein:

the turning positions of all of the outer layers are placed at predetermined peripheral positions of the bobbin.

11. The winding method as in claim 10, wherein:

the turning positions of all of the outer layers are placed at one predetermined peripheral position of the bobbin.

12. The winding method as in claim 9, wherein:

the turning positions of all the outer layers are set by moving a single position setter to the turning positions corresponding to respective layers.

13. The winding method as in claim 9, wherein:

the turning position of each outer layer is set by an individual setting member corresponding to each layer.

14. A of winding a multi-layer coil in a winding apparatus of a bobbin having a center pillar, a small flange connected to one end of the center pillar and a large flange connected to the other end of the center pillar, the winding space being defined outside the center pillar between both flanges and having a trapezoidal cross-section in a plane cut through a center axis of the center pillar, the winding method comprising:

winding a wire around the center pillar of the bobbin in an inner space between the small flange and the large flange, forming inner layers of the wire, until a height of the inner layers reaches a height of the small flange; and further winding the wire around the inner layers, forming outer layers of the wire, while gradually decreasing, layer by layer, number of wire-turns included in each layer by setting a turning position where each layer moves up to a next layer and by shifting the turning position toward the large flange, thereby forming the multi-layer coil encompassed within the winding apparatus having the trapezoidal cross-section, wherein: the turning positions of all of the outer layers are set by a fixed single position setter that includes a plurality of setting steps, each step corresponding to the turning position of each outer layer.

* * * * *